US005764206A

United States Patent [19]

Koyama et al.

[11] Patent Number: 5,764,206

[45] Date of Patent: Jun. 9, 1998

[54] DRIVE CIRCUIT AND METHOD FOR DESIGNING THE SAME

[75] Inventors: Jun Koyama; Yuji Kawasaki, both of Kanagawa, Japan

[73] Assignee: Semiconductor Energy Laboratory Co., Ltd., Kanagawa-ken, Japan

[21] Appl. No.: 423,087

[22] Filed: Apr. 18, 1995

[30] Foreign Application Priority Data

Apr. 22, 1994 [JP] Japan ..... 6-107572

[51] Int. Cl.[6] ..... G09G 3/36

[52] U.S. Cl. ..... 345/80; 345/98; 257/59; 349/46

[58] Field of Search ..... 345/100, 80, 92, 345/98; 437/21, 40, 41, 44; 359/58, 59; 257/348, 327, 336, 337, 338, 344, 59, 72; 349/42, 43, 45, 46

[56] References Cited

U.S. PATENT DOCUMENTS

| | | | |
|---|---|---|---|
| 4,243,997 | 1/1981 | Natori et al. | 257/330 |
| 5,151,759 | 9/1992 | Vinal | 257/348 |
| 5,330,941 | 7/1994 | Yaba et al. | 501/54 |
| 5,412,493 | 5/1995 | Kunii et al. | 359/59 |
| 5,526,318 | 6/1996 | Slemmer et al. | 365/226 |
| 5,529,941 | 6/1996 | Huang | 437/44 |

OTHER PUBLICATIONS

Tanaka et al., Characteristics of Offset–Structure Polycrystalline–Silicon Thin–Film Transistors, Jan. 1988, pp. 23–25.

DeRycke et al., The Realisation and Evaluation of Poly–CdSe TFT Driving Circuits, 1988, pp. 70–73.

*Primary Examiner*—Andrew Faile
*Assistant Examiner*—Andrew B. Christensen
*Attorney, Agent, or Firm*—Sixbey Friedman Leedom & Ferguson; Gerald J. Ferguson, Jr.; Evan R. Smith

[57] ABSTRACT

Fluctuations in an image quality of an active matrix type display device are reduced. The active matrix type display device is driven by a drive circuit constructed of a shift register, an analog memory constructed of an analog switch and a capacitor, and an analog buffer formed by a thin-film transistor. In this drive circuit, a channel length of the thin-film transistor for constituting said analog buffer is made longer than a channel length of a thin-film transistor for constituting either said analog switch, or said shift register.

20 Claims, 9 Drawing Sheets

EXAMPLE (1)

EXAMPLE (2)

DRIVE CIRCUIT AND METHOD FOR DESIGNING THE SAME

BACKGROUND OF THE INVENTION

1. Field of the Invention

The present invention generally relates to a drive circuit for an active matrix type display device constructed of thin-film transistors. More specifically, the present invention is directed to a drive circuit for such an active matrix type display device that fluctuations in characteristics of analog buffers are suppressed.

2. Description of the Related Art

It should be understood in this specification that an active matrix type display device implies such a display device that a pixel is positioned at each of intersecting portions in a matrix, switching elements are provided with all of these pixels, and image information is controllable by turning ON/OFF these switching elements. As a display medium of such a display device, there are provided a liquid crystal, plasma, substances and states whose optical characteristics (e.g., reflectivity, refractive index, transmittance, and intensity of light emission) are electrically controllable. In the present invention, in particular, a three-terminal element is employed as the switching element, namely a field-effect transistor having a gate, a source, and a drain.

Furthermore, the following definition of a "matrix" is made in the present specification: A row of this matrix implies that a signal line (gate line) located in parallel to this row is connected to a gate electrode of a transistor belonging to this row, whereas a "column" of this matrix implies that a signal line (source line) arranged in parallel to this column is connected to a source (otherwise drain) electrode of a transistor belonging to this column. Furthermore, a circuit for driving a gate line is referred to a gate drive circuit, and another circuit for driving a source line is called as a source drive circuit.

In FIG. 1, there is schematically shown the structure of the typical conventional active matrix type liquid crystal display device.

Since the vertical scanning timing signal is produced from the gate drive circuit for the active matrix type display apparatus, the shift registers are series-connected to each other to constitute a single serial circuit, whose number is equal to that of the gate lines along the vertical direction. In this manner, the thin-film transistors employed in the active matrix type liquid crystrical display device is switched by this gate drive circuit.

On the other hand, since the image data along the horizontal direction is displayed on the active matrix type liquid crystal display device by the source drive circuit, the shift registers are series-connected with each other to constitute a single serial circuit, whose number is equal to that of the source lines along the horizontal direction. The above-described analog switches are turned ON/OFF in response to the latch pulse in synchronism with the horizontal scanning signal. Thus the source drive circuit may flow the currents through the thin-film transistors of the active matrix type liquid crystal device so as to control orientation of the liquid crystal cells.

The operations of the typical active matrix type liquid crystal device will now be described with reference to FIG. 1.

The horizontal scanning timing signal is produced from the shift register X and the video (image) signal is stored in the analog memory in response to this timing signal. The image (video) data held in the analog memory is inputted into the analog buffer. The analog buffer supplies the image data to the source lines of the thin-film transistors employed in the active matrix type display devise at the timing of the latch pulse.

On the other hand, the shift register Y produces the vertical scanning timing signal to supply this timing signal to the gate lines of the thin-film transistors employed in the active matrix type display device. As a result, the current supplied to the source lines of the thin-film transistors may flow so as to determine orientation of the liquid cells connected to the drain lines of these thin-film transistors.

As described above, this typical active matrix type liquid crystal display device is operated in the above-mentioned manner.

As the load capacity of the liquid crystal per se is large, the thin-film transistor of the active matrix type display device cannot be directly driven by the image data stored in the analog memory. Accordingly, such an analog buffer for constituting the source drive circuit is required.

An analog buffer implies such a circuit for directly shifting an input signal, or shifting the input signal as to only a DC component thereof, whose output impedance may be set to be sufficiently low with respect Lo a load. A structure of such an analog buffer is mainly arranged by a source-follower type differential amplifier, and a feedback type differential amplifier. A typical structural example is shown in FIG. 2 and FIG. 3.

As shown in FIG. 2, the source-follower type analog buffer is constructed by connecting the constant current source to either the source electrode of the N type thin-film transistor, or the source electrode of the P type thin-film transistor. The output voltage is dropped, or increased by the gate-to-source voltage $V_{GS}$ of this thin-film transistor from the input voltage.

As represented in FIG. 3, since the analog buffer constructed by employing the feedback type differential amplifier uses the differential amplifier, the output voltage becomes equal to the input voltage. It should be noted that the delay time of this feedback type differential amplifier is longer than that of the above-explained source-follower type differential amplifier, and therefore the feedback type differential amplifier is not suitable to a high speed response.

The drive circuits of the conventional active matrix type display device own the below-mentioned problems:

As indicated in FIG. 4, the channel length of the thin-film transistor for constituting the analog switch is designed to be equal to that for constituting the analog buffer in the above-described drive circuits.

Since great progress is made in the current semiconductor manufacturing technology, severe designing rules are required to increase integration of semiconductor circuits, so that the channel lengths of the thin-film transistors of the drive circuits are made very fine.

When the channel length of the analog buffer would be made very fine, adverse influences caused by errors in the photolithography precision and the etching precision during the manufacturing stages of the thin-film transistor having such a very fine channel length could become large.

A relationship between a change in channel lengths of a thin-film transistor and a threshold voltage of this thin-film transistor is obtained by performing an experiment, and is illustrated in FIG. 5. As seen from this relationship, the shorter the channel length "L" of the thin-film transistor becomes, the lower the threshold voltage becomes.

Moreover, the shorter the channel length "L" becomes, the larger the change becomes.

As represented in FIG. 5, when the channel length "L" is made very fine, error of the etching precision plus and minus of "DL" is produced, and a large difference is made between the threshold voltages $V_{th1}$ and $V_{th2}$ of the thin-film transistor corresponding to the respective channel lengths, and further large fluctuations occur in the characteristic of the analog buffer. As a consequence, these factors may cause display fluctuations of the pixels in the active matrix type display device. This display fluctuation is produced by the fluctuation of the voltage $V_{th}$ applied to the liquid crystal element when a uniform monochromatic figure is displayed thereon.

FIG. 6 graphically shows a characteristic of transmittance and an applied voltage of a normally white liquid crystal element. As shown in this graphic representation, the fluctuation in transmittance appears, depending upon a fluctuation width of $\Delta V_{th}$ of the applied voltage $V_{th}$.

When either the LDD region, or the offset region is entered into the thin-film transistors for constituting the above-described analog buffer, these regions become the source resistance, so that the voltage drop is produced by the source current flowing therethrough, and thus the resultant threshold voltage $V_{th}$ would be virtually increased. As a consequence, this may also cause fluctuations in the threshold voltage of the thin-film transistor.

In FIG. 7, there is shown an equivalent circuit of such a condition that either the LDD region or the offset region is entered into the thin-film transistor.

SUMMARY OF THE INVENTION

To solve the above-described problems, the present invention may provide the below-mentioned means:

A channel length "L" of a thin-film transistor for constituting the above-described analog buffer and a threshold voltage of this thin-film transistor are measured and represented in FIG. 5.

A range of the channel length "L" is determined from FIG. 5A and FIG. 5B in such a manner that a difference in the respective threshold voltage values of the thin-film transistors, which corresponds to a positive/negative error in etching precision of the channel length "L" of the thin-film transistor for forming the analog buffer, should become very small.

Within the range of the channel "L" where the difference in the threshold voltages becomes very small, a minimum value is employed as the channel length, and then only the channel length of the thin-film transistor for constituting the analog buffer is manufactured based on this design rule.

When the channel length of the thin-film transistor for constituting the analog buffer becomes long, the operation speed of this thin-film transistor is lowered. However, if the operation speed of the analog buffer becomes higher than the horizontal scanning period (15 kHz to 30 kHz), then this does not cause any problem. Therefore, there is no operational problem even when the channel length is increased, the capacitance is increased, and the drain current is reduced.

As described above, the fluctuations in the characteristic of the analog buffer can be suppressed according to the present invention.

It should be noted that since no such a sever threshold voltage is required by the channel length of the thin-film transistor for constituting the analog switch, or the logic circuit, even when this channel length is manufactured in accordance with the very fine design rule, as compared with that for the analog buffer, no problem is produced.

Also, since the operation speed of the logic circuit is inverse proportional to a square of the channel length, the channel length is preferably selected to be short. As a consequence, the channel length of the thin-film transistor other than that for the analog buffer is suitably selected to be shorter than, or equal to 5 microns due to the lithographic relationship of the liquid crystal device.

Then, in case that the thin-film transistor for constituting the analog buffer has either an LDD region, or an offset region, widths of the LDD region and the offset region are made narrower than those of other circuit.

BRIEF DESCRIPTION OF THE DRAWINGS

For a better understanding of the present invention, reference is made of the detailed description to be read in conjunction with the accompanying drawings in which.

DETAILED DESCRIPTION OF THE PREFERRED EMBODIMENTS

A first description will now be made of an LDD (Light Dope Drain) region of a thin-film device employed in a drive circuit of an active matrix type liquid crystal display device according to the present invention.

In this case, a complementary type inverter circuit is introduced. As an underlayer oxide film, a silicon oxide film having a thickness of 1,000 to 3,000 Å was manufactured on a glass substrate (low alkali glass Such as Corning 7059 (trade name), or crystal glass is used). As the method for forming this oxide film, the sputtering method in the oxygen atmosphere was employed. However, such a film formed by resolving/depositing TEOS by way of the plasma CVD method may be used so as to further increase mass productivity.

Thereafter, an amorphous silicon film was deposited with a thickness of 300 to 5,000 Å, preferably 500 to 1,000 Å by way of the plasma CVD method and the LPCVD method. The deposited amorphous silicon film was positioned in the reducing atmosphere for 4 to 48 hours to be crystallized. After this manufacturing stage, the crystallized film may be illuminated by laser light so as to be crystallized at a higher degree. Then, the crystallized silicon film was patterned to form island regions 1 and 2. In addition, a silicon oxide film 3 having a thickness of 700 to 1,500 Å was manufactured on these island regions by way of the sputtering method.

Figure 8A:
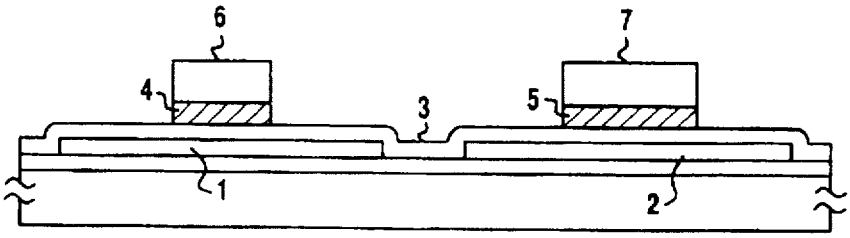
FIGS. 8*a*–8*f* schematically show a method for manufacturing a complementary type inverter circuit with an LDD region according to an embodiment of the present invention.

Subsequently, an aluminum film (containing Si at 1 wt % and $S_r$ at 0.1 to 0.3 wt %) having a thickness of 1,000 Å to 3 micrometers was formed by way of the electron beam vapor deposition method, or the sputtering method. Then, a photoresist (e.g., OFPR 800/30 cp manufactured by TOKYO Ohka Co, Ltd) was formed by way of the spin coat method. When prior to a formation of this photoresist, an aluminum oxide film having a thickness of 100 to 1,000 Å was formed on the surface by way of the anode oxidization method, close contact could be established between the photoresist and the formed film. A leak current from the photoresist was suppressed, so that a porous anode oxide could be effectively fabricated only on a side surface thereof. Then, both of the photoresist and the aluminum film are patterned and are etched away together with the aluminum film, thereby constituting gate electrodes 4 and 5, and also mask films 6 and 7 (see FIG. 8*a*).

Figure 8B:
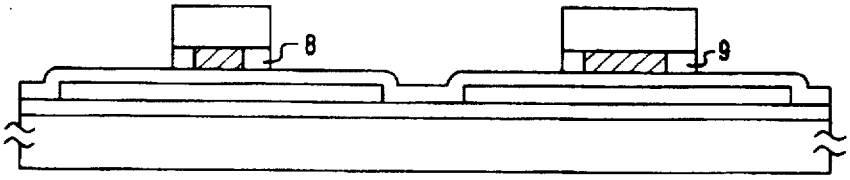

Furthermore, a current flowed through the resultant to oxidize the anode, so that an anode oxide having a thickness of 3,000 to 6,000, e.g., 5,000 Å was formed. The anode oxidation may be carried out by employing either acid water solution such as nitric acid, phosphoric acid, chromium acid, and sulfuric acid, or 3 to 20% of citric acid, while such a constant voltage between 10 V and 30 V may be applied to the gate electrode. In this preferred embodiment, the voltage was selected to be 10 V, and the anode oxidation was performed for 20 to 40 minutes in the nitric acid solution (30° C.). A thickness of the anode oxide was controlled based on anode oxidation time (see FIG. 8*b*).

Next, the mask films were removed, and a current is again supplied to the gate electrode in the electrolytic solution. In this case, ethylene glycol solution containing 3 to 10% of citric acid, boric acid, and sulfuric acid was employed. A better oxide film could be obtained under such a condition that the temperature of this solution was lower than the room temperature at approximately 10° C. As a consequence, barrier type anode oxide 10 and 11 were fabricated on an upper surface and a side surface of the gate electrode. The thickness of the anode oxide 10, 11 is in proportional to the applied voltage. For example, when the applied voltage was selected to be 150 V, the anode oxide having the thickness of 2,000 Å was formed. Although the thickness of the anode oxide 10, 11 were determined based on the dimension of the required offset, such a high voltage higher than 250 V is required so as to form the anode oxide having the thickness thicker than 3,000 Å, which may give adverse influences to the characteristics of the thin-film transistor. Under such a circumstance, the thickness of this anode oxide is preferably made less than 3,000 Å. In this embodiment, the applied voltage was increased up to 80 to 150 V, and selected to be a proper value, depending upon the thickness of the required anode oxide films 10 and 11.

A great attention should be paid to such a fact that although the barrier type anode oxidation is executed at the later stage, the barrier type anode oxide is not fabricated outside the porous anode oxide, but the barrier type node oxide 10, 11 is fabricated between the porous anode oxide 8, 9 and the gate electrodes 4, 5.

Figure 8C:
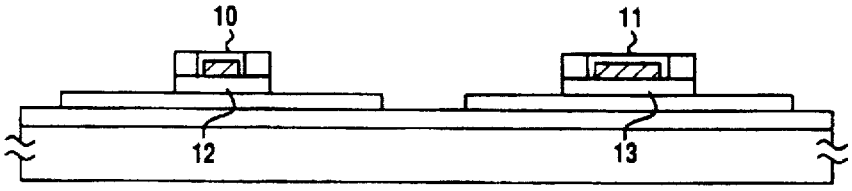

Then, an insulating film 3 was etched away by way of the dry etching method (otherwise, wet etching method). It should be noted that this etching depth is arbitrarily determined, for example, the etching process is carried out until the underlying activated layer is exposed, or this etching treatment is interrupted halfway. However, in view of the mass productivity, yield, and uniformity, it is preferable to carry out the etching process until the activated layer is exposed. In this case, the insulating films 12 and 13 having the original thickness are left as the insulating films (gate insulating films) underlying the regions covered by the anode oxide 8, 9 and the gate electrodes 4, 5 (see FIG. 8*c*).

In a method for manufacturing the LDD (Light Dope Drain) region, the anode oxide 8 and 9 were removed after executing of the above-explained operations. As an etchant, phosphoric acid solution, for example, a mixture of phosphoric acid, acetic acid, and nitric acid is preferably employed. In this case, with respect to the phosphoric acid etchant, the etching rate of the porous anode oxide is higher than, or equal to 10 times of the etching rate of the barrier type anode oxide. As a consequence, since the barrier type anode oxide 10, 11 were not substantially etched by the phosphoric acid etchant, the gate electrodes located inside the barrier type anode oxide could be protected from the etching treatment.

Figure 8D:
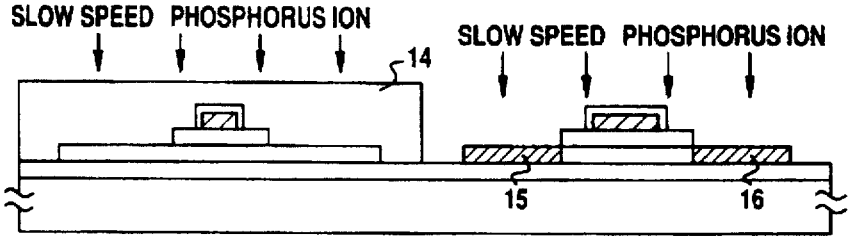

With this structure, either Accelerated N type impurity ion, or accelerated P type impurity ion was injected into the activated layer, so that a source and a drain were fabricated. First, under such a condition that a left-sided region of the thin-film transistor was covered with a mask 14, phosphorus ion was irradiated to this region at a relatively slow speed (typically, acceleration voltage was between 5 kV and 30 kV) by way of the ion doping method. In this preferred embodiment, the acceleration voltage was selected to be 20 kV. As the doping gas, phosphine (PH3) was employed. A dose amount was selected to be $5\times10^{14}$ to $5\times10^{15}$ $cm^{-2}$. In this stage, since the phosphorus ion could not pass through the insulating film 13, the phosphorus ion was injected into only the region within the activated layer, whose surface was exposed, so that a drain 15 and a source 16 of an N-channel type thin-film transistor (see FIG. 8*d*).

Figure 8E:
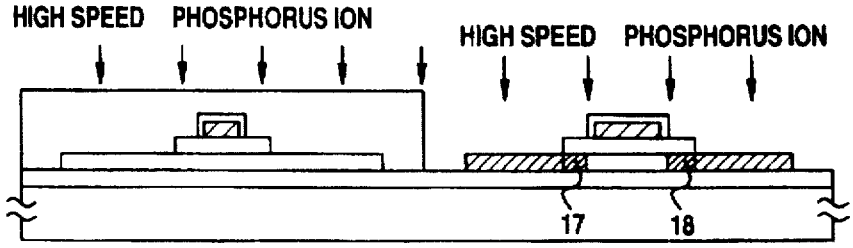

Subsequently, phosphorus ion was similarly irradiated at a relatively high speed (typically, acceleration voltage was between 60 kV and 120 kV) by way of the ion doping method. In this preferred embodiment, the acceleration voltage was selected to be 90 kV. A dose amount was from $1\times10^{13}$ to $5\times10^{14}$ $cm^{-2}$. In this stage, the phosphorus ion may penetrate the insulating film 13 and reach the underlying layer thereof. However, since the dose amount was small, N type region LDDs 17 and 18 were fabricated with low concentration (see FIG. 8*e*).

After the phosphorus doping was completed, the mask 14 was removed. Then, the N-channel type thin-film transistor was masked, and a source 19, a drain 20, and also P type region LDDs 21, 22 were similarly formed. Thereafter, KrF excimer laser (wavelength of 248 nm and pulse width of 20 nsec) was irradiated to activate the impurity ion injected into the activated layer.

As described above, the LDD region could be manufactured.

Figure 8F:
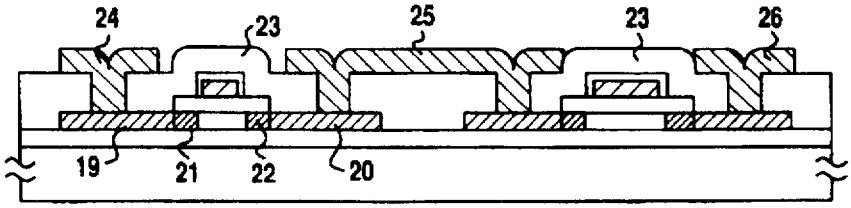

Finally, as an interlayer insulator 23, a silicon oxide film with a thickness of 3,000 to 6,000 Å was formed on the entire surface by way of the CVD method. Then, a contact hole was formed in the source/drain of the thin-film transistor, and aluminum wiring patterns/electrodes 24, 25, 26 were made. Furthermore, the resultant product was processed by the hydrogen annealing at the temperatures between 200° C. and 400° C. With employment of the above-described manufacturing steps, the complementary type inverter circuit with using the thin-film transistors was accomplished (see FIG. 8*f*).

Next, a description will now be made of an offset region of a thin-film device employed in the drive circuit of an active matrix type liquid crystal display device according to the present invention.

In this case, a complementary type inventer circuit is introduced. As an underlayer oxide film, a siliconoxide film having a thickness of 1,000 to 3,000 Å was manufactured on a glass substrate (low alkali glass such as Corning 7059 (trade name), or crystal glass is used). As the method for forming this oxide film, the sputtering method in the oxygen atmosphere was employed. However, such a film formed by resolving/depositing TEOS by way of the plasma CVD method may be used so as to further increase mass productivity.

Thereafter, an amorphous silicon film was deposited with a thickness of 300 to 5,000 Å, preferably 500 to 1,000 Å by way of the plasma CVD method and the CPCVD method. The deposited amorphous silicon film was positioned in the reducing atmosphere for 4 to 48 hours to be crystallized. After this manufacturing stage, the crystallized film may be illuminated by laser light so as to be crystallized at a higher degree. Then, the crystallized silicon film was patterned to form island regions 31 and 32. In addition, a silicon oxide film 33 having a thickness of 700 to 1,500 Å was manufactured on these island regions by way of the sputtering method.

Figure 9A:
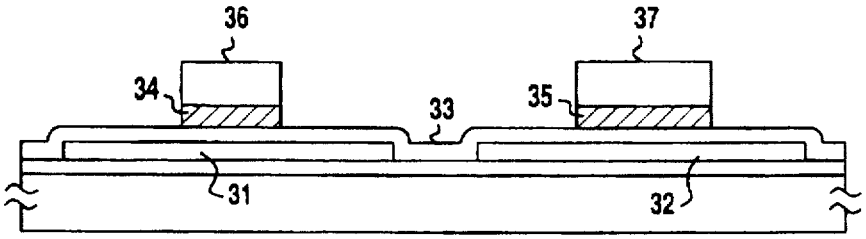
FIGS. 9*a*–9*f* schematically indicates a method for manufacturing a complementary type inverter circuit with an offset region, according to an embodiment of the present invention.

Subsequently, an aluminum film (containing Si at 1 wt % and $S_r$ at 0.1 to 0.3 wt %) having a thickness of 1,000 Å to 3 micrometers was formed by way of the electron beam vapor deposition method, or the sputtering method. Then, a photoresist (e.g., OFFPR 800/30 cp manufactured by TOKYO Ohka Co, Ltd) was formed by way of the spin coat method. When prior to a formation of this photoresist, an aluminum oxide film having a thickness of 100 to 1,000 Å was formed on the surface by way of the anode oxidization method, close contact could be established between the photoresist and the formed film. A leak current from the photoresist was suppressed, so that a porous anode oxide could be effectively fabricated only on a side surface thereof. Then, both of the photoresist and the aluminum film are patterned and are etched way together with the aluminum film, thereby constituting gate electrodes 34 and 35, and also mask films 36 and 37 (see FIG. 9*a*).

Figure 9B:
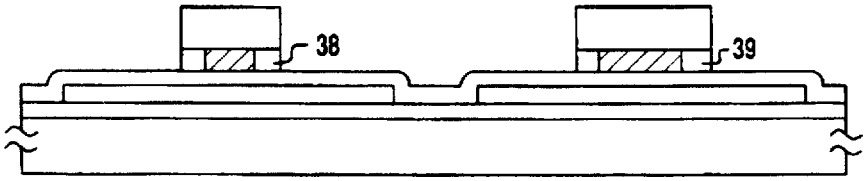

Furthermore, a current flowed through the resultant to oxidize the anode, so that an anode oxide having a thickness of 3,000 to 6,000, e.g., 5,000 Å was formed. The anode oxidation may be carried out by employing either acid water solution such as nitric acid, phosphoric acid, chromium acid, and sulfuric acid, or 3 to 20% of citric acid, while such a constant voltage between 10 V and 30 V may be applied to the gate electrode. In this preferred embodiment, the voltage was selected to be 10 V, and the anode oxidation was performed for 20 to 40 minutes in the nitric acid solution (30° C.). A thickness of the anode oxide was controlled based on anode oxidation time (see FIG. 9*b*).

Next, the mask films were removed, and a current is again supplied to the gate electrode in the electrolytic solution. In this case, ethylene glycol solution containing 3 to 10% of citric acid, boric acid, and sulfuric acid was employed. A better oxide film could be obtained under such a condition that the temperature of this solution was lower than the room temperature at approximately 10° C. As a consequence, barrier type anode oxide 40 and 41 were fabricated on an upper surface and a side surface of the gate electrode. The thickness of the anode oxide 40, 41 is in proportional to the applied voltage. For example, when the applied voltage was selected to be 150 V, the anode oxide having the thickness of 2,000 Å was formed. Although the thickness of the anode oxide 40, 41 were determined based on the dimension of the required offset, such a high voltage higher than 250 V is required so as to form the anode oxide having the thickness thicker than 3,000 Å, which may give adverse influences to the characteristics of the thin-film transistor. Under such a circumstance, the thickness of this anode oxide is preferably made less than 3,000 Å. In this embodiment, the Applied voltage was increased up to 80 to 150 V, and selected to be a proper value, depending upon the thickness of the required anode oxide films 40 and 41.

A great attention should be paid to such a fact that although the barrier type anode oxidation is executed at the later stage, the barrier type anode oxide is not fabricated outside the porous anode oxide, but the barrier type anode oxide 40, 41 is fabricated between the porous anode oxide 38, 39 and the gate electrodes 34, 35.

Figure 9C:
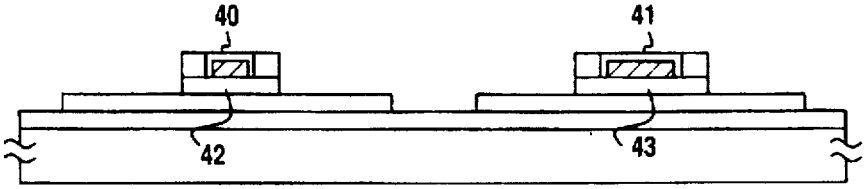

Then, an insulating film 33 was etched away by way of the dry etching method (otherwise, wet etching methods). It should be noted that this etching depth is arbitrarily determined, for example the etching process is carried out until the underlying activated layer is exposed, or this etching treatment is interrupted halfway. However, in view of the mass productivity, yield, and uniformity, it is preferable to carry out the etching process until the activated layer is exposed. In this case, the insulating films 42 and 43 having the original thickness are left as the insulating films (gate insulating films) underlying the regions covered by the anode oxide 38, 39 and the gate electrodes 34, 35 (see FIG. 9*c*).

Figure 9D:
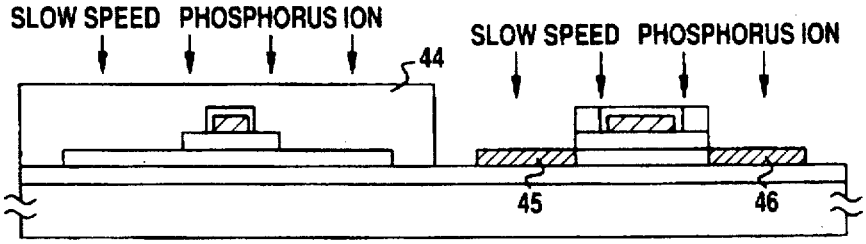

In a method for manufacturing the offset region, with employment of this structure, either accelerated N type impurity ion, or accelerated P type impurity ion was injected into the activated layer, so that a source and a drain were fabricated. First, under such a condition that a left-sided region of the thin-film transistor was covered with a mask 44, phosphorus ion was irradiated to this region at a relatively slow speed (typically, acceleration voltage was between 5 kV and 30 kV) by way of the ion doping method. In this preferred embodiment, the acceleration voltage was selected to be 20 kV. As the doping gas, phosphine (PH3) was employed. A dose amount was selected to be $5\times10^{14}$ to $5\times10^{15}$ $cm^{-2}$. In this stage, since the phosphorus ion could not pass through the insulating film 43, the phosphorus ion was injected into only the region within the activated layer, whose surface was exposed, so that a drain 45 and a source 46 of an N-channel type thin-film transistor (see FIG. 9*d*).

Thereafter, the anode oxide 38 and 39 were removed. As an etchant, phosphoric acid solution, for example, a mixture of phosphoric acid, acetic acid, and nitric acid is preferably employed. In this case, with respect to the phosphoric acid etchant, the etching rate of the porous anode oxide is higher than, or equal to 10 times of the etching rate of the barrier type anode oxide. As a consequence, since the barrier type anode oxide 40, 41 were not substantially etched by the phosphoric acid etchant, the gate electrodes located inside the barrier type anode oxide could be protected from the etching treatment.

Figure 9E:
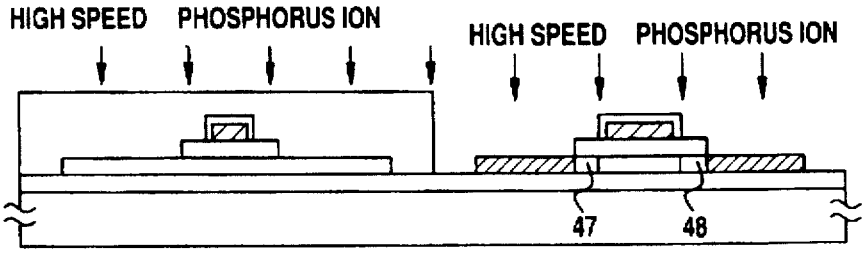

In this manner, the offset region could be formed (see FIG. 9*e*).

Figure 9F:
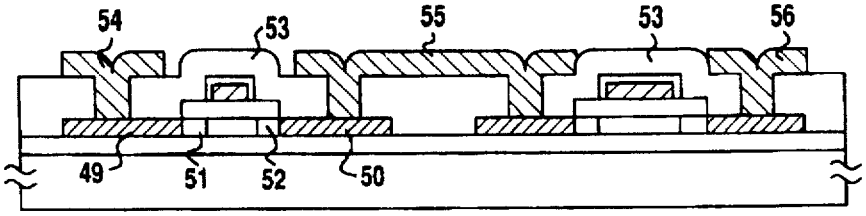

Finally, as an interlayer insulator 53, a silicon oxide film with a thickness of 3,000 to 6,000 Å was formed on the entire surface by way of the CVD method. Then, a contact hole was formed in the source/drain of the thin-film transistor, and aluminum wiring patterns/electrodes 54, 55, 56 were made. Furthermore, the resultant product was processed by the hydrogen annealing at the temperatures between 200° C. and 400° C. With employment of the above-described manufacturing steps, the complementary type inverter circuit with using the thin-film transistors was accomplished (see FIG. 9*f*).

While the present invention has been described with respect to the inverter circuits, the present invention may be applied to other circuits. Although the coplanar type thin-film transistor has been described in the above-described embodiments, the present invention may be similarly applied to not only the coplanar type thin-film transistor, but also other types of thin-film transistors such as the reverse stagger type thin-film transistor.

Furthermore, although the above-described process has been performed at the low temperature of 600° C., the present invention may be realized in such a high temperature process higher than 800° C.

Figure 5A:
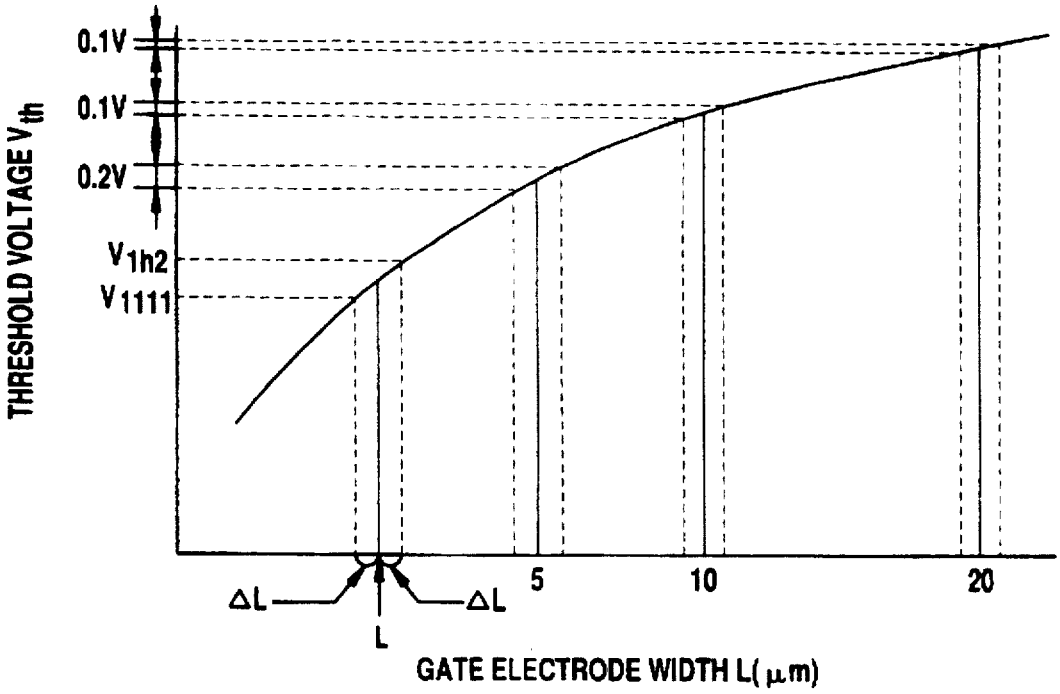
FIGS. 5(A) and 5(B) graphically represent the relationship between the channel length "L" of the thin-film transistor and the threshold voltage "$V_{th}$" thereof.

FIG. 5A graphically indicates a relationship between a channel length "L" and a threshold voltage $V_{th}$ of a thin-film transistor.

Assuming now that the channel length "L" is set to be 5 micrometers and etching error is 0.3 micrometers, a variation amount $\Delta V_{th}$ of the threshold voltage $V_{th}$ of this thin-film transistor becomes approximately 0.2 V.

Then, when the channel length "L" is set to be 10 micrometers and the etching error is 0.3 micrometers, the variation amount $\Delta V_{th}$ of the threshold voltage $V_{th}$ of this thin-film transistor may be suppressed to about 0.1 V.

When the channel length "L" is set to 20 micrometers and the etching error is 0.3 micrometers, the variation amount $\Delta V_{th}$ of the threshold voltage $V_{th}$ of this thin-film transistor may be suppressed to about 0.1 V.

As represented in FIG. 5A, if the channel length of the thin-film transistor for constituting the above-described analog buffer is set to be longer than, or equal to 10 micrometers, then the variation amount of the threshold voltage $V_{th}$ of this thin-film transistor becomes very small, which does not cause any problem in the characteristic of the analog buffer. In this case, fluctuations in transmittance of the liquid crystal may be suppressed from 11% to 6% because the present invention is employed.

Figure 5B:
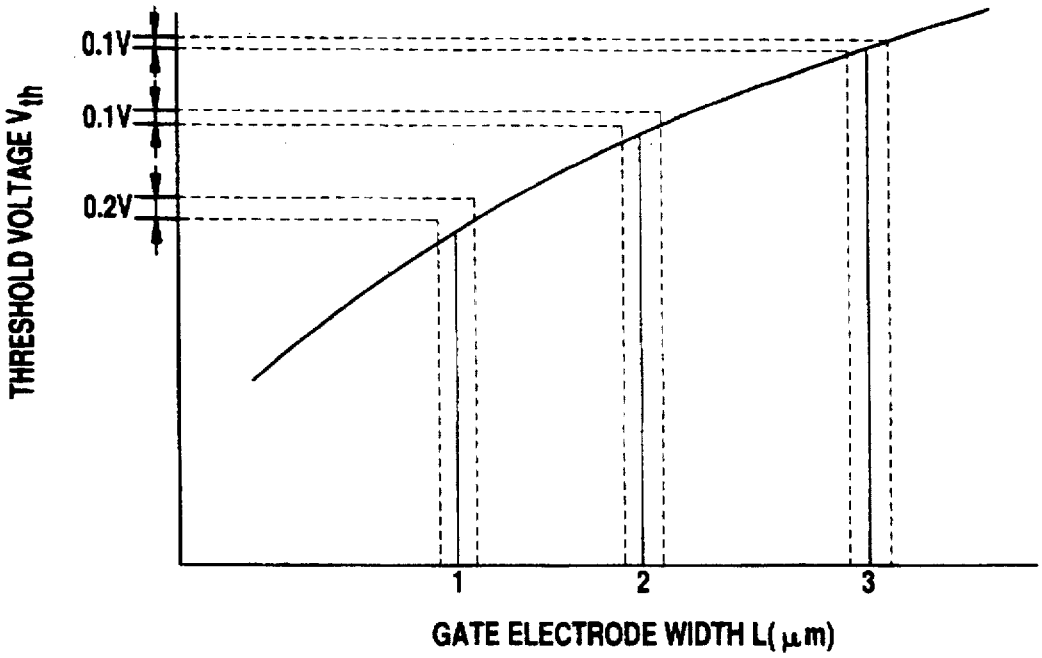
Figure 6:
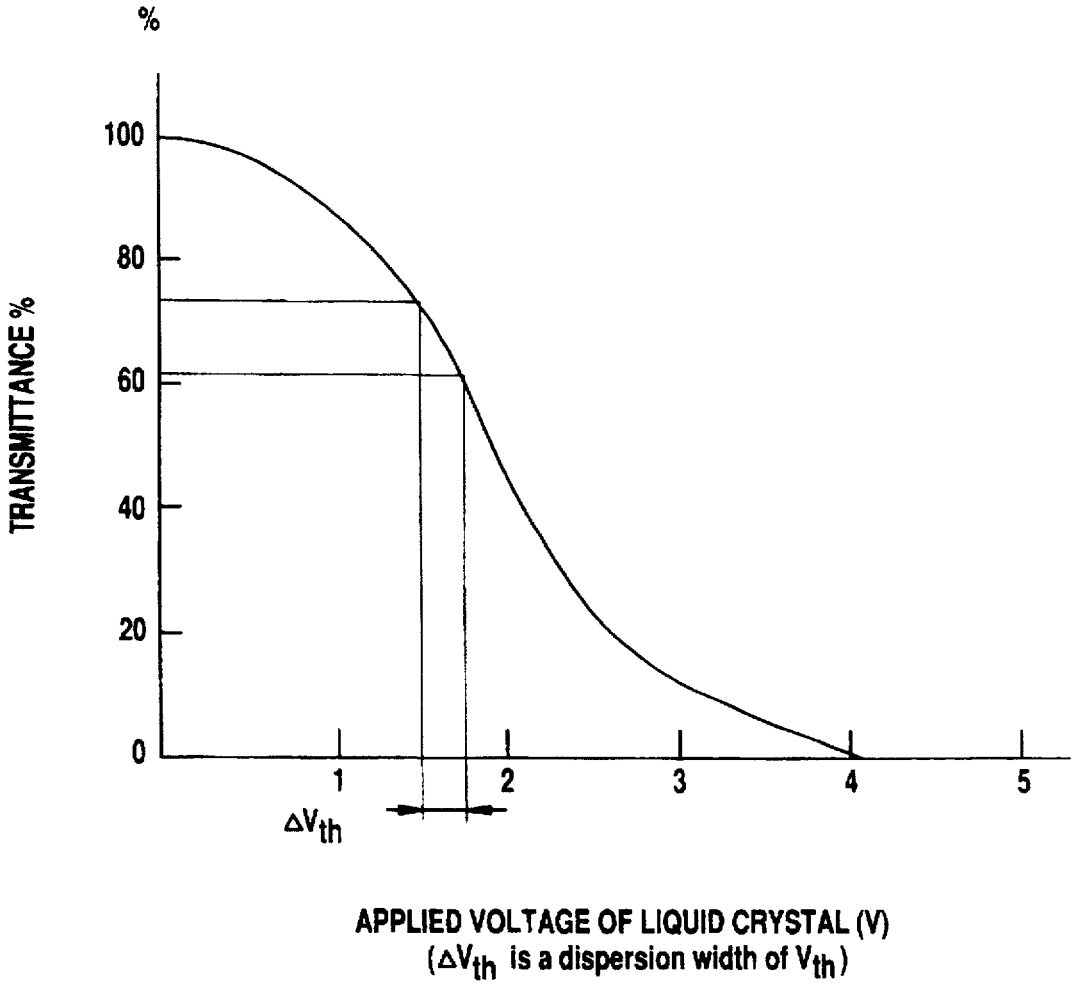
FIG.6 PRIOR ART
FIG. 6 graphically indicates the relationship between the applied voltage and the transmittance of the conventional normally white liquid crystal element.

It is now assumed in FIG. 5B that the design rule becomes very fine.

Assuming that the channel length "L" is set to be 1 micrometer and the etching error is improved, i.e., 0.1 micrometer, the variation amount $\Delta V_{th}$ of the threshold voltage $V_{th}$ of this thin-film transistor become approximately 0.2 V.

Then, when the channel length "L" is set to be 2 micrometers and the etching error is 0.1 micrometer, the variation amount $\Delta V_{th}$ of the threshold voltage $V_{th}$ of this thin-film transistor may be suppressed to about 0.1 V.

When the channel length "L" is set to 4 micrometers and the etching error is 0.1 micrometer, the variation amount $\Delta V_{th}$ of the threshold voltage $V_{th}$ of this thin-film transistor may be suppressed to about 0.1 V.

As indicated in FIG. 5B, if the design rule becomes very fine, then the etching error becomes small accordingly. As a consequence, if the channel length becomes long, then the variation amount of the threshold voltage becomes small, i.e., substantially equal to that of the present design rule.

In accordance with the present invention, the TN (twist nematic) liquid crystal having a relatively slow variation of transmittance is preferably employed as the liquid crystal material.

As a concrete example of the analog buffer, the above-described source follower and differential amplifier will now be explained.

Figure 1:
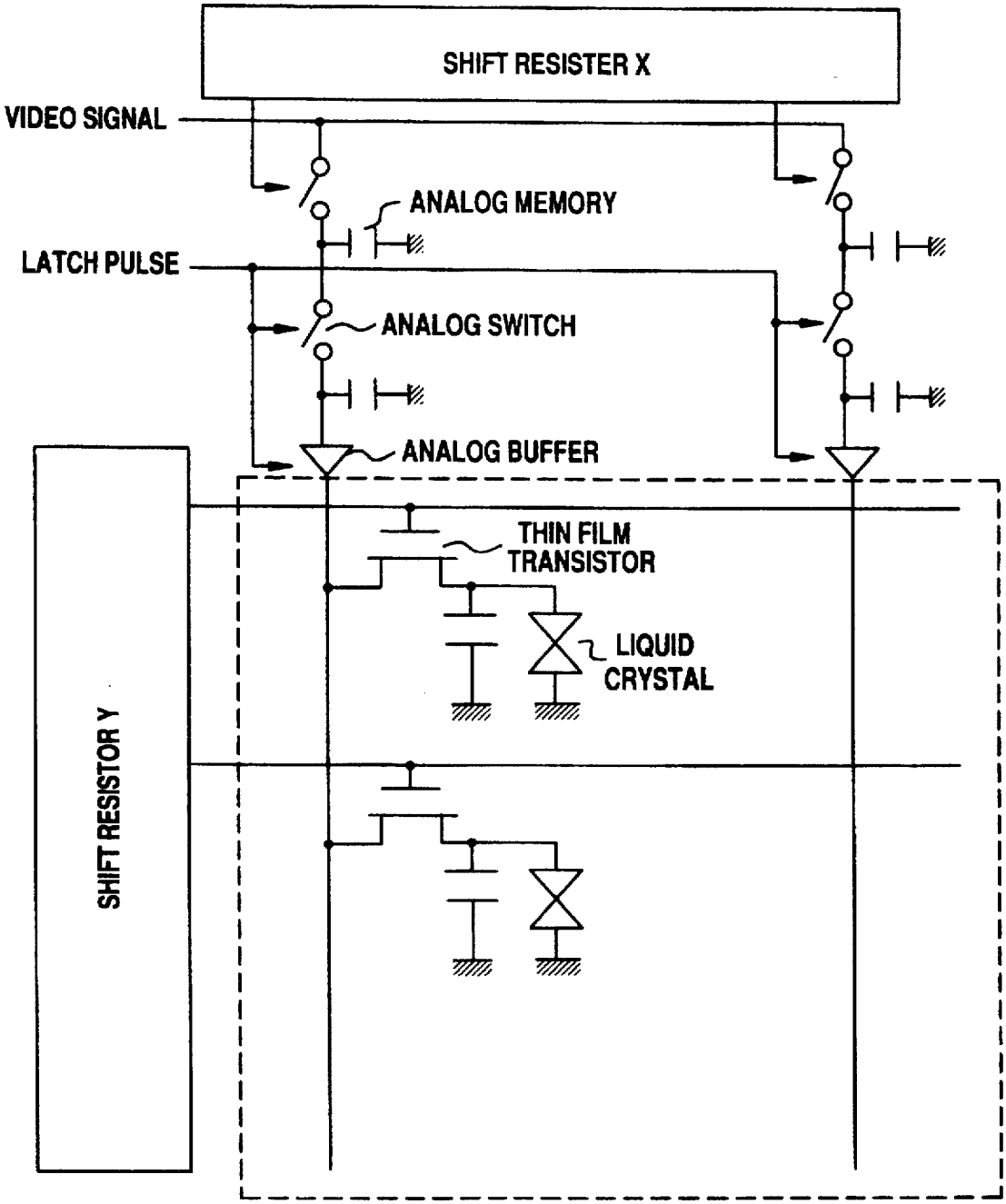
FIG. 1 PRIOR ART
FIG. 1 schematically shows the conventional active matrix type liquid crystal display device.
Figure 2A:
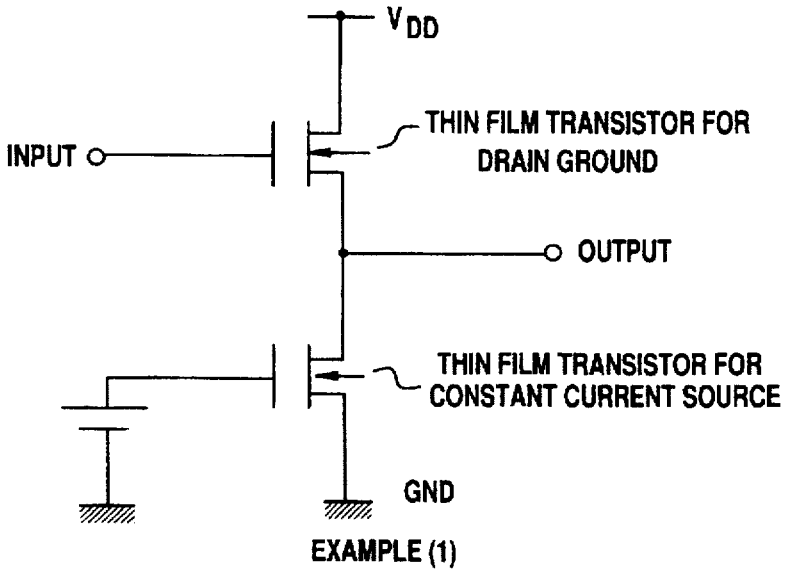
FIG.2A PRIOR ART
FIG. 2 illustrates two examples of conventional analogue buffers.
Figure 2B:
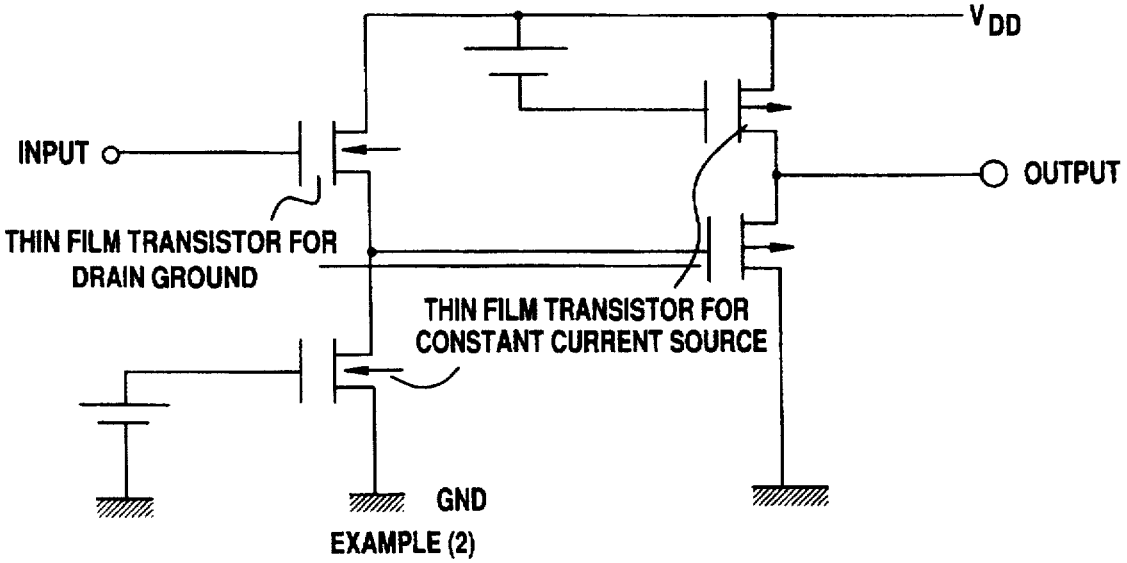
FIG.2B PRIOR ART
Figure 7:
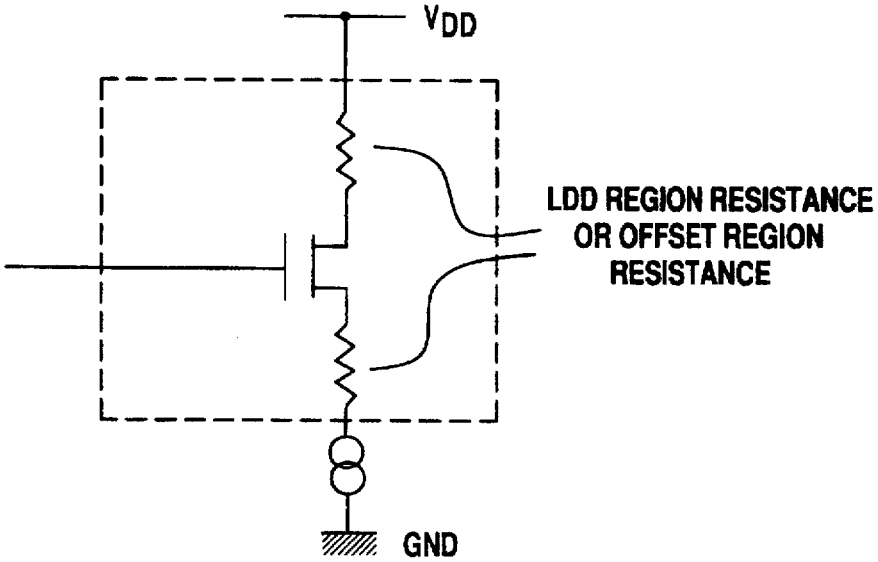
FIG.7 PRIOR ART
FIG. 7 shows the equivalent circuit of the thin-film transistor having the LDD region and the offset region.
Figure 3:
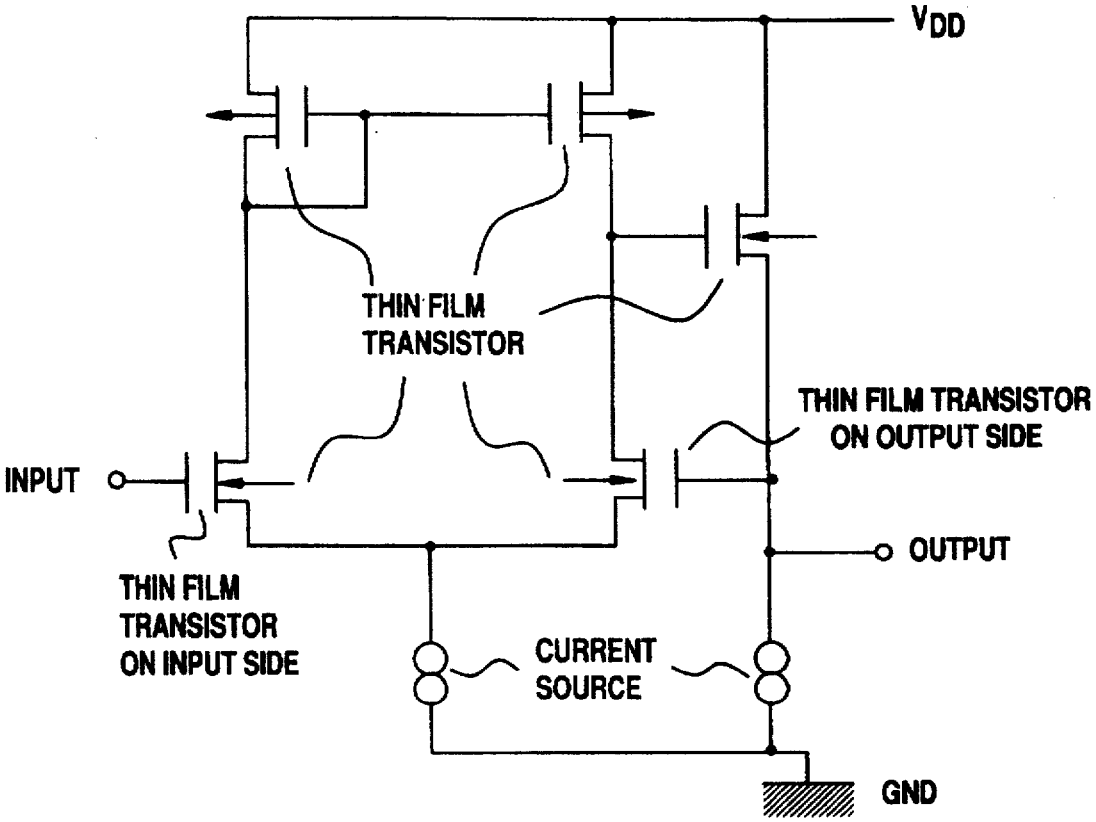
FIG.3 PRIOR ART
FIG. 3 is a circuit diagram for representing the conventional analog buffer.

Considering now that, as represented in FIG. 2, the source follower is arranged by the thin-film transistor functioning as the drain grounding transistor, and the thin-film transistor functioning as the constant current source, when a voltage applied to the gates electrode of the constant current source thin-film transistor is $V_{G1}$, a value $I_D$ of a constant current is given by the following equation (1):

$$I_D=\mu_0 C_0 W(V_{G1}-V_{TH1})^2/(2L)\ (V_{TH1}\text{ is the threshold voltage}) \quad (1)$$

It should be noted in this equation (1) that symbol "μo" indicates mobility, symbol "Co" denotes a unit capacitance of a gate oxide film, symbol "L" shows a channel length, and symbol "W" denotes a channel width.

In order that this current may flow through the thin-film transistor whose drain is grounded, assuming now that the gate-to-source voltage is $V_{G2}$ and the threshold voltage of this transistor is $V_{TH2}$, the value $I_D$ of the constant current is expressed by the following equation (2):

$$I_D=\mu_0 C_0 W(V_{G2}-V_{TH2})^2/(2L) \quad (2)$$

As a result, the following equation can be established:

$$V_{G1}-V_{TH1}=V_{G2}-V_{TH2} \quad (3)$$

Accordingly, since the output voltage of the source follower is $V_{G2}$, this voltage is defined by the below-mentioned equation (4)

$$V_{G2}=V_{G1}+V_{TH2}-V_{TH1} \quad (4)$$

Therefore, when a difference between the threshold voltages $V_{TH1}$ and $V_{TH2}$ can be made small in accordance with the present invention, the output voltage is substantially equal to $V_{G1}$, so that uniformity of the overall circuit can be improved.

Considering the feedback type differential amplifier, the output voltage from this feedback type differential amplifier becomes $V_{GS3}-V_{GS4}$, assuming that the gate-to-source voltage of the transistor provided at the input terminal is $V_{GS3}$ and the gate-to-source voltage of the transistor provided at the output terminal is $V_{GS4}$.

Here, if the drain current of the transistor provided at the input terminal is $I_{D1}$ and the drain current of the transistor located at the output terminal is $I_{D2}$, then these drain currents are given by the following equations (5) and (6):

$$I_{D2}=\mu_0 C_0 W(V_{GS3}-V_{TH3})^2/(2L) \quad (5)$$

$$I_{D2}=\mu_0 C_0 W(V_{GS4}-V_{TH4})^2/(2L) \quad (6)$$

If these drain currents $I_{D1}$ and $I_{D2}$ are equal to each other, then the gate-to-source voltages are defined by the following equations (7) and (8):

$$V_{GS3}-V_{TH3}=V_{GS4}-V_{TH4} \quad (7)$$

$$V_{GS3}-V_{GS4}=V_{TH3}-V_{TH4} \quad (8)$$

As a consequence, when a difference between these threshold voltages $V_{TH3}$ and $V_{TH4}$ can be made small in accordance with the present invention, a difference between the input voltage and the output voltage can become substantially zero.

Figure 10:
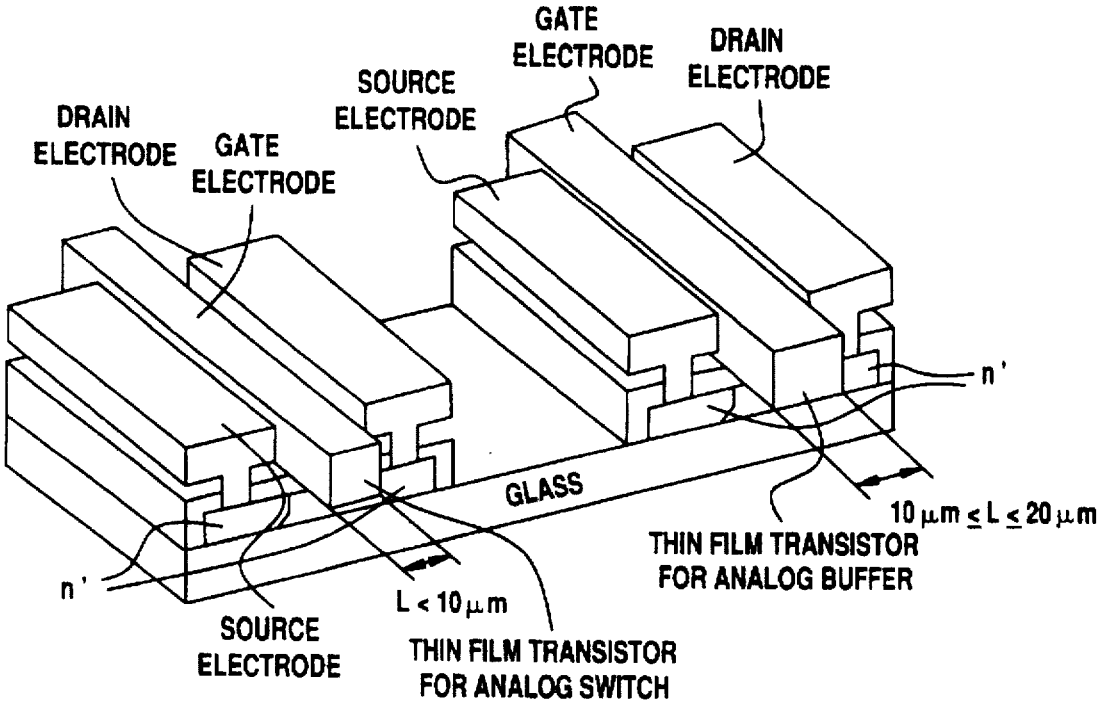
FIG. 10 schematically shows a structure of a thin-film transistor of an analog buffer of a drive circuit for an active matrix type liquid crystal display device according to an embodiment of the present invention.
Figure 4:
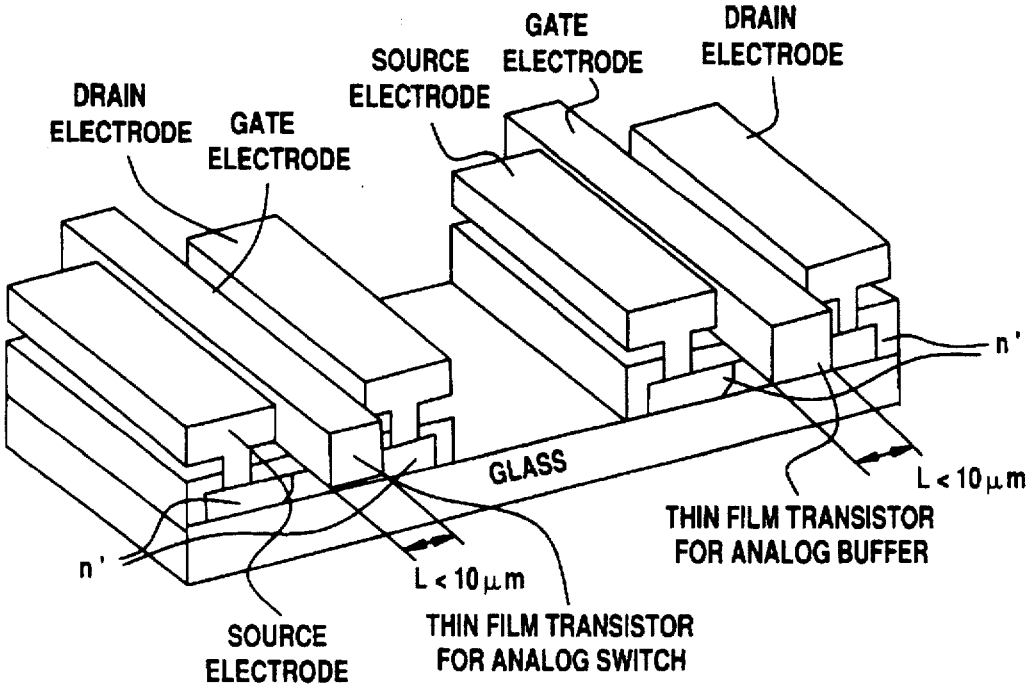
FIG.4 PRIOR ART
FIG. 4 schematically indicates the structure of the thin-film transistor of the analog buffer of the drive circuit for the conventional active matrix type liquid crystal display device.

In FIG. 10, there is shown such an embodiment of the present invention that the above-described analog buffer in which the channel length of the thin-film transistor is set between 10 microns and 20 microns, and analog switch in which a channel length of a thin-film transistor is set to be less than 10 microns are manufactured.

Figure 11:
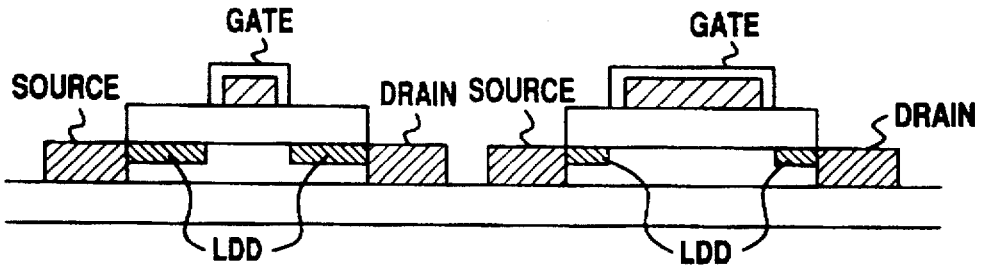
FIG. 11 schematically represents a structure of the LDD region of the thin-film transistor according to the present invention.
Figure 12:
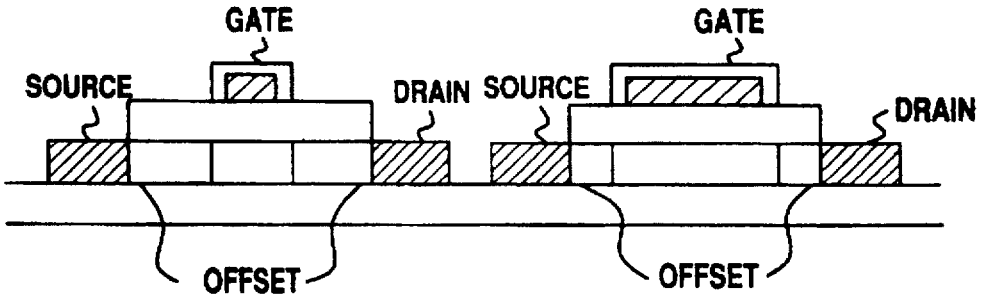
FIG. 12 schematically indicates a structure of the offset region of the thin-film transistor according to the present invention.

FIG. 11 and FIG. 12 schematically represent analog buffers according to the present invention, in which an LDD region and an offset region of a thin-film transistor are separately indicated.

In order that the LDD region and the offset region of the above-explained analog buffer are made smaller than those of other circuit, the following means may be utilized.

Since the LDD region and the offset region are fabricated by the anode oxidation stage according to the present invention, the formation time of these regions is made shorter than the formation time by the anode oxidation stage for other circuit, so that the above-described purpose can be achieved.

Although the above description has been made of the complementary type drive circuit, when the analog buffer is arranged by a source follower, this buffer may be constructed of only either an N type circuit, or P type circuit.

In accordance with the present invention, since the design rule is varied with respect to each of the internal functions of the drive circuit for the active matrix type liquid crystal display device, fluctuations in the output voltage characteristic of the analog buffer can be suppressed.

As to only the channel length of the analog buffer employed in the drive circuit, when the design rule about the thin-film transistor is theoretically made loosened, namely the channel is made sufficiently wide, the variation amount of the threshold voltage $V_{th}$ becomes negligibly small.

However, there is such a practical solution. That is, taking account of a balancing matter between the design rule of another thin-film transistor employed in the drive circuit and the occupation ratio of the circuit area to the substrate area, the channel length of the thin-film transistor for constituting the analog buffer is preferably selected to be two times to four times longer than that of other circuit.

When either the LDD region or the offset region of the thin-film transistor for constituting the analog buffer is made smaller than that of other circuit, or made zero, fluctuations in $\Delta V_{th}$, may be reduced.

As previously explained, according to the advantages of the present invention, the fluctuations in the output voltages characteristic of the analog buffer can be suppressed, so that the image quality and the yield of the active matrix type liquid crystal display device can be improved.

What is claimed is:

1. A drive circuit of an active matrix type display device, comprising:

a shift register;

an analog memory constructed of an analog switch and a capacitor; and an analog buffer formed by a thin-film transistor, wherein:

a channel length of the thin-film transistor for constituting said analog buffer is made longer than a channel length of a thin-film transistor for constituting either said analog switch, or said shift register.

2. A drive circuit of an active matrix type display device as claimed in claim 1 wherein said analog buffer is constructed of a source follower.

3. A drive circuit of an active matrix type display device as claimed in claim 1 wherein said analog buffer is constructed of a feedback type differential amplifier.

4. A drive circuit of an active matrix type display device as claimed in claim 1 wherein:

the channel length of the thin-film transistor for constituting the analog buffer is selected to be two times to four times longer than that of a thin-film transistor for constituting a device other than said analog buffer employed in said drive circuit.

5. A drive circuit of an active matrix type display device as claimed in claim 1 wherein:

LDD regions are formed in both ends of the channel of the thin-film transistor for constituting said drive circuit; and a width of the LDD region of the thin-film transistor for constituting said analog buffer is made smaller than a width of the LDD region of the thin-film transistor for constituting another circuit.

6. A drive circuit of an active matrix type display device as claimed in claim 1 wherein:

offset regions are formed in both ends of the channel of the thin-film transistor for constituting said drive circuit; and a width of the offset region of the thin-film transistor for constituting said analog buffer is made smaller than a width of the offset region of the thin-film transistor for constituting another circuit.

7. A drive circuit of an active matrix type display device as claimed in claim 1 wherein:

LDD regions are formed in both ends of all of said thin-film transistors for constituting the drive circuit, other than the thin-film transistor for constituting said analog buffer; and neither an LDD region, nor an offset region is formed in the channel of the thin-film transistor for constituting said analog buffer.

8. A drive circuit of an active matrix type display device as claimed in claim 1 wherein:

offset regions are formed in both ends of all of said thin-film transistors for constituting the drive circuit, other than the thin-film transistor for constituting said analog buffer; and neither an LDD region, nor an offset region is formed in the channel of the thin-film transistor for constituting said analog buffer.

9. A drive circuit of an active matrix type display device as claimed in any one of the preceding claims 1 to 8 wherein said thin-film transistor is one of an N type transistor, or a P type transistor.

10. A drive circuit of an active matrix type display device as claimed in any one of the preceding claims 1 to 8 wherein said thin-film transistor is a complementary type transistor.

11. A drive circuit of an active matrix type display device as claimed in any one of the preceding claims 1 to 10 wherein said thin-film transistor is fabricated under a low temperature process lower than, or equal to 600° C.

12. A drive circuit of an active matrix type display device as claimed in any one of the preceding claims 1 to 10 wherein said thin-film transistor is fabricated under a high temperature process higher than, or equal to 800° C.

13. A method for designing a drive circuit of an active matrix type display device, wherein:

a drive circuit comprises a shift register, an analog memory constructed of an analog switch and a capacitor, and an analog buffer formed by a thin-film transistor; and a determination of a channel length of the thin-film transistor for constituting said analog buffer is performed in such a range that an increasing amount of a threshold voltage of said thin-film transistor becomes very small with respect to an increasing amount of said channel length.

14. A drive circuit of an active matrix type display device, wherein:

a drive circuit comprises a shift register, an analog memory constructed of an analog switch and a capacitor, and an analog buffer formed by a thin-film transistor; and each of internal functions of said drive circuit for the active matrix type display device is arranged by thin-film transistors having channel lengths different from each other.

15. A drive circuit of an active matrix type display device, comprising:

a shift register;

an analog memory constructed of an analog switch and a capacitor; and an analog buffer formed by a thin-film transistor, wherein:

a gate electrode width of the thin-film transistor for constituting said analog buffer is made longer than a gate electrode width of a thin-film transistor for constituting either said analog switch, or said shift register.

16. A drive circuit of an active matrix type display device as claimed in claim 15 wherein said gate electrode width of the thin-film transistor for constituting said analog buffer is substantially equal to a channel length of the thin-film transistor for constituting said analog buffer, and said gate electrode width of the thin-film transistor for constituting said analog switch is substantially equal to a channel length of the thin-film transistor for constituting said analog switch, and said gate electrode width of the thin-film transistor for constituting said shift register is substantially equal to a channel length of the thin-film transistor for constituting said shift register.

17. A method for designing a drive circuit of an active matrix type display device, wherein:

a drive circuit comprises a shift register, an analog memory constructed of an analog switch and a capacitor, and an analog buffer formed by a thin-film transistor; and a determination of a gate electrode width of the thin-film transistor for constituting said analog buffer is performed in such a range that an increasing amount of a threshold voltage of said thin-film transistor becomes very small with respect to an increasing amount of said gate electrode width.

18. A method for designing a drive circuit of an active matrix type display device as claimed in claim 17 wherein said gate electrode width of the thin-film transistor for constituting said analog buffer is substantially equal to a channel length of the thin-film transistor for constituting said analog buffer.

19. A drive circuit of an active matrix type display device, wherein:

a drive circuit comprises a shift register, an analog memory constructed of an analog switch and a capacitor, and an analog buffer formed by a thin-film transistor; and each of internal functions of said drive circuit for the active matrix type display device is arranged by thin-film transistors having gate electrode widths different from each other.

20. A drive circuit of an active matrix type display device as claimed in claim 19 wherein said gate electrode widths are substantially equal to channel lengths of said thin-film transistors, respectively.

* * * * *